US006112638A

United States Patent [19]

Loechner

[11] Patent Number: 6,112,638

[45] Date of Patent: Sep. 5, 2000

[54] ELECTROPNEUMATIC POSITIONER HAVING BINARY INPUT ARRANGEMENT PROVIDING ACCESS TO ELECTRICAL OUTPUT FUNCTIONS THEREOF

[75] Inventor: Michael Loechner, Filderstadt, Germany

[73] Assignee: The Foxboro Company, Foxboro, Mass.

[21] Appl. No.: 09/303,065

[22] Filed: Apr. 30, 1999

[51] Int. Cl.[7] ..... F15B 9/09

[52] U.S. Cl. ..... 91/363 A; 91/363 R; 137/85

[58] Field of Search ..... 91/363 R, 363 A; 137/85

[56] References Cited

U.S. PATENT DOCUMENTS

| | | | |
|---|---|---|---|
| 4,304,389 | 12/1981 | McLeod . | |
| 4,343,454 | 8/1982 | Kure-Jensen et al. . | |
| 4,473,876 | 9/1984 | Minnich | 91/363 A X |
| 4,545,017 | 10/1985 | Richardson . | |
| 4,595,343 | 6/1986 | Thompson et al. . | |
| 5,031,735 | 7/1991 | Holmes . | |
| 5,329,956 | 7/1994 | Marriott et al. . | |
| 5,613,419 | 3/1997 | Pierson et al. . | |
| 5,665,898 | 9/1997 | Smith et al. . | |
| 5,931,180 | 8/1999 | Nagasaka | 91/363 R X |

FOREIGN PATENT DOCUMENTS 0 286-722 A1 10/1988 European Pat. Off. .

OTHER PUBLICATIONS

*TZID–C Intelligent Positioner Data Sheet*, pp. 1–18, Published by Hartman & Braun, Oct. 1998.

*Electric Drive System, Style B, MI 200–411 Instruction Manual*, pp. 1–20, Published by The Foxboro Company, Oct. 1980.

*SRD991 Intelligent Positioner, Product Specifications Manual*, pp. 1–12,Published by Foxboro–Eckardt, May 1998.

*SRD992 Digital Positioner, Product Specification Manual*, pp. 1–12, Published by Foxboro–Eckardt, Jul. 1998.

*Primary Examiner*—Gerald A. Michalsky

*Attorney, Agent, or Firm*—Richard L. Sampson

[57] ABSTRACT

The present invention includes an electropneumatic positioner having an external binary input block which provides access to the electrical output of an integral electronic position controller to control operation of a valve relay. The invention enables manual control of the positioner for safety, maintenance etc.

29 Claims, 9 Drawing Sheets

Example for Fast Exhaust with Low Supply Pressure

ELECTROPNEUMATIC POSITIONER HAVING BINARY INPUT ARRANGEMENT PROVIDING ACCESS TO ELECTRICAL OUTPUT FUNCTIONS THEREOF

BACKGROUND OF THE INVENTION

1. Field of the Invention

This invention relates to electropneumatic positioners for pneumatically actuated valves, and more particularly, to an apparatus and method for electrically overriding operation of an electrically controlled electropneumatic positioner.

2. Background Information

Throughout this application, various publications, patents and published patent applications are referred to by an identifying citation. The disclosures of the publications, patents and published patent applications referenced in this application are hereby incorporated by reference into the present disclosure.

Modern process plants contain innumerable operating components. These components are tied together to form systems controlled by instrumentation and control systems containing sensors and controllers. The instrumentation and control systems on such plants not only serve to control the functions of the various components in order to achieve the desired process conditions, but they also provide the facility to safely modify or discontinue operation of all or a portion of the plant's systems in order to avoid an unsafe situation or condition.

One of the means by which such safety systems function is by the securing or diverting of the supply of a certain process or control fluid, or the supply of motive power to a plant system or component of a plant system. Such systems often utilize pneumatically operated valves. One of the means by which the safety functions can be accomplished is through the use of solenoid operated valves connected in series between the pneumatic control source and the pneumatically operated valve.

In operation, the pneumatic valves or actuators are isolated from the pneumatic control source and pressure within the actuator is vented off when the solenoid of the solenoid valve is repositioned (e.g., de-energized). In this manner, the pneumatic actuator may return to a configuration designated for safety. An example of a safety system which utilizes solenoid valves within a pneumatic system is disclosed in U.S. Pat. No. 5,665,898, to Smith et al. An example of a typical plant system including a pneumatic actuator and a solenoid valve safety device is shown in FIG. 1.

Referring to FIG. 1, conventional electropneumatic positioners 10 typically include an electronic position controller such as a microprocessor 12 which controls operation of a pneumatic valve relay 14 pursuant to signals 32 received from a factory automation system or other computer network 34. An example of such a positioner 10 is Model No. SRD991-BFMS2FAA available from The Foxboro Company of Foxboro, Mass., USA. Relay 14 in turn directs pneumatic fluid (air or other gas) along a conduit 15 through a solenoid valve 16 to a pneumatic actuator 18. Actuator 18 includes a stem 20 which is movable in response to the pneumatic pressure to actuate (i.e., open or close) a fluid process control valve 22. One or more sensors 24 may be utilized to detect the actual position of stem 20 to provide position feedback to the controller 12 as shown at 35. Any difference between the system setpoint signal 32 and the position feedback signal 24 then may be determined and corrected for by the position controller 12.

As shown, the solenoid valve 16 is included as a safety device to quickly exhaust the pneumatic pressure in the event of a malfunction etc., to move the actuator 18 to its safe configuration and thus effectively override the controller 12. For example, the solenoid valve 16 may be utilized to exhaust the pneumatic fluid (i.e., air), in the event the pressure of the pneumatic supply 40 drops below a predefined limit, such as may occur during a plant shutdown due to compressor fault, etc., to dispose actuator 18 in its depressurized (i.e., safe) position.

While the use of solenoid valve 16 may provide sufficient safety in many applications, it is not without drawbacks. For example, provision and installation of the solenoid valve 16 and pneumatic conduit associated therewith disadvantageously increases the material and labor (i.e., installation) cost of the electropneumatic positioner 10. Further, solenoid valve 16 typically operates in a binary fashion i.e., the valve is operable between fully open and fully closed positions. This aspect thus tends to require that the flow through valve 22 be completely discontinued (rather than being partially reduced) when in the safety configuration. Moreover, the solenoid valve 16 should be tested periodically to help ensure proper operation thereof. Such testing thus tends to disadvantageously generate frequent interruption of the flow through valve 22.

Thus, a need exists for an improved device and method for selectively overriding control signals to a pneumatic actuator.

SUMMARY OF THE INVENTION

According to an embodiment of this invention, an electropneumatic positioner for controlling operation of a pneumatic valve actuator includes a position controller electrically coupled to a pneumatic relay which selectively couples, decouples and modulates pneumatic fluid flow to the pneumatic valve actuator in response to signals transmitted by the position controller. At least one binary input is integrally coupled to the position controller, so that a change of state of the binary input selectively effects one of a plurality of functions.

The present invention provides, in a second aspect, an electropneumatic positioner for controlling operation of a pneumatic valve actuator, which includes an electronic position controller, a pneumatic relay electrically coupled to the position controller and pneumatically coupled to the pneumatic valve actuator, and a setpoint signal input port integrally coupled to the position controller. A binary input is integrally coupled to the position controller, so that a change of state of the binary input selectively overrides setpoint signals inputted to the setpoint signal input port.

In a third aspect, a method for controlling operation of a pneumatic valve actuator, includes the steps of:

(a) providing a position controller;

(b) providing a pneumatic relay;

(c) electrically coupling the position controller to the pneumatic relay;

(d) pneumatically coupling the pneumatic relay to the pneumatic valve actuator;

(e) integrally coupling at least one binary input to the position controller;

(f) utilizing the position controller to transmit control signals to the pneumatic relay to selectively couple, decouple and modulate pneumatic fluid flow to the pneumatic valve actuator; and (g) selectively changing the state of the at least one binary input to selectively determine which one of a plurality of control signals is transmitted from the position controller to the pneumatic relay.

In a fourth aspect of the present invention, an electropneumatic positioner for controlling operation of a pneumatic valve actuator includes a positioner controller and a pneumatic relay electrically coupled to the position controller and pneumatically coupled to the pneumatic valve actuator. The position controller transmits control signals to the pneumatic relay to effect selective coupling, decoupling and modulation of pneumatic fluid flow between the pneumatic relay and the pneumatic valve actuator. A port is electrically coupled to the position controller to receive a setpoint signal from a remote processor. Binary inputs are integrally coupled to the position controller, so that a change of state of at least one of the binary inputs selectively overrides the setpoint signal inputted at the port to control signals from the position controller to the pneumatic relay.

The above and other features and advantages of this invention will be more readily apparent from a reading of the following detailed description of various aspects of the invention taken in conjunction with the accompanying drawings.

DETAILED DESCRIPTION OF THE PREFERRED EMBODIMENTS

Figure 1:
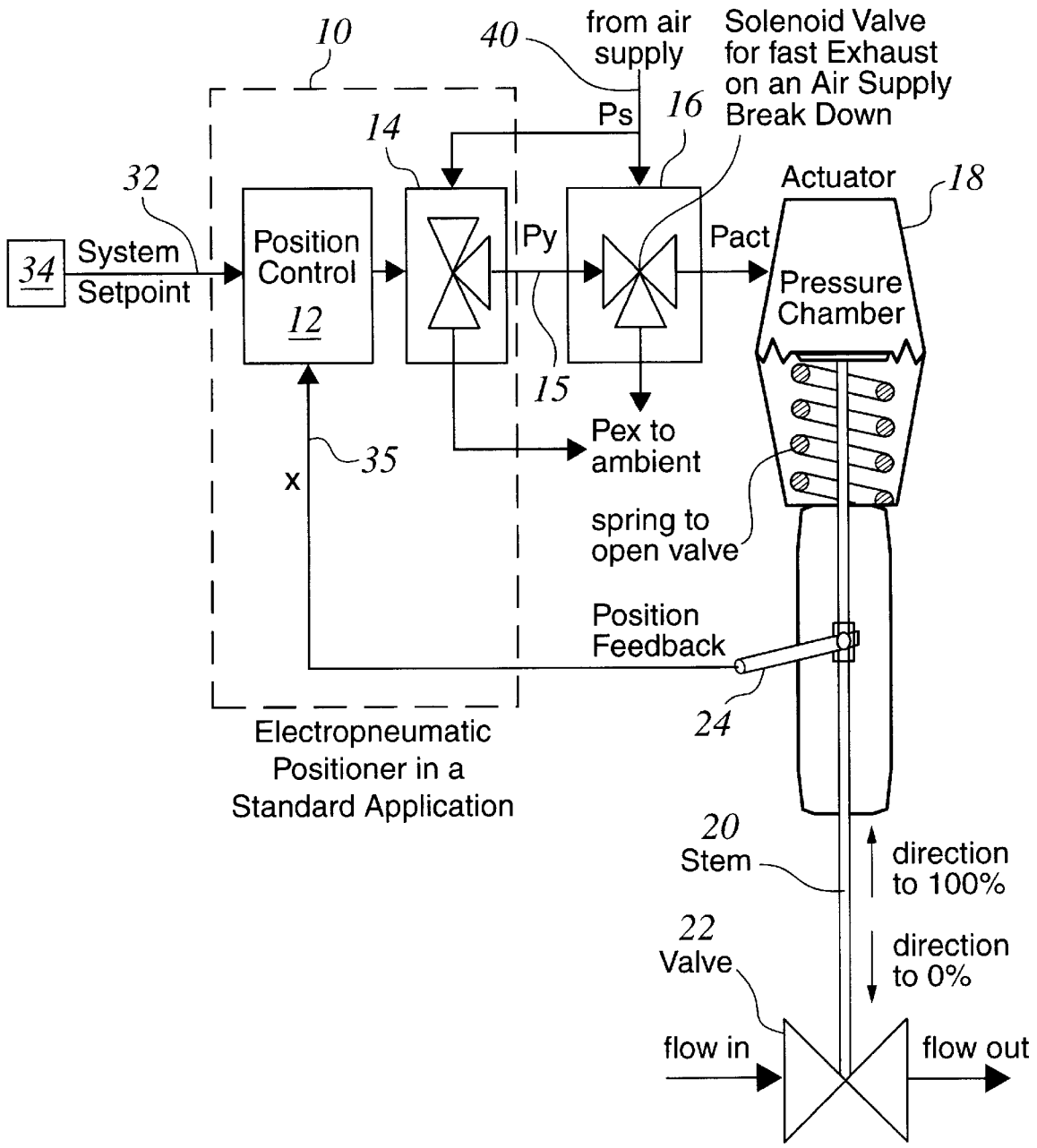
FIG. 1 Prior Art
FIG. 1 is a schematic block diagram of a prior art electropneumatic positioner in a conventional application.

Referring to the figures set forth in the accompanying Drawings, the illustrative embodiments of the present invention will be described in detail hereinbelow. For clarity of exposition, like features shown in the accompanying Drawings shall be indicated with like reference numerals and similar features as shown in alternate embodiments in the Drawings shall be indicated with similar reference numerals.

Referring to FIGS. 2–7, the apparatus constructed according to the principles of the present invention, in various applications, is shown. The present invention includes an electropneumatic positioner 10' having an external binary input arrangement (i.e., a binary input block) 30, which provides direct access to the electrical output of an integral electronic position controller 12 to control operation of a valve relay 14.

Figure 2:
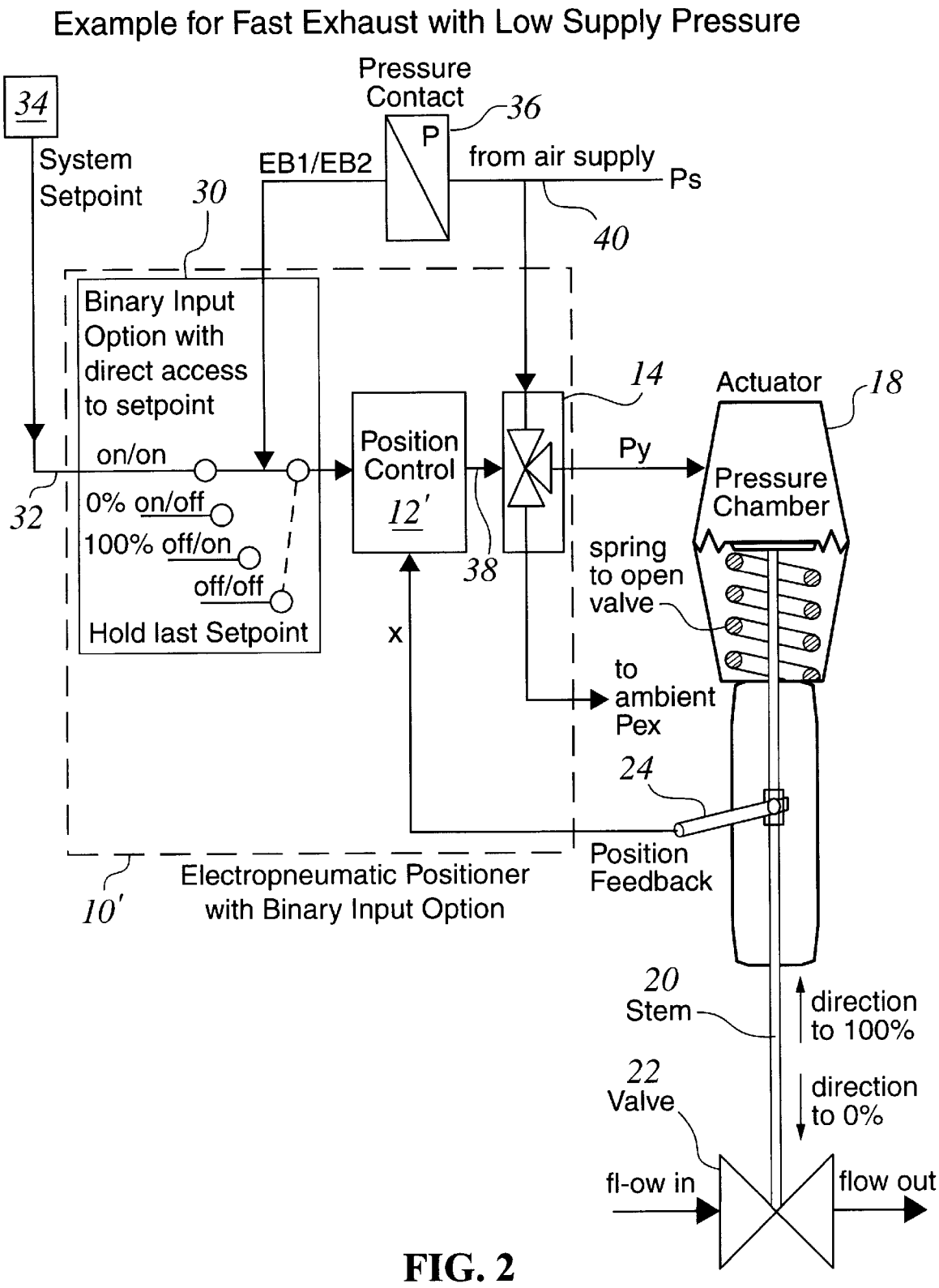
FIG. 2 is a view similar to that of FIG. 1, of an electropneumatic positioner with binary inputs of the present invention, in a representative application.

The apparatus and method of the present invention will be more thoroughly described hereinbelow. As shown in FIG. 2, electropneumatic positioner 10' is in many respects similar to positioner 10, with the inclusion of a binary input block 30 electrically coupled to a position controller 12'. Controller 12' is substantially similar to controller 12, while preferably including software and/or hardware adapted to provide input block 30 with it's desired functionality as will be described hereinabove. Alternatively, controller 12' may be substantially identical to controller 12, as in the event such desired functionality is provided by software and/or hardware embedded or otherwise disposed integrally with the input block 30 as will be described hereinbelow.

In a preferred embodiment as shown, binary input block 30 includes two binary inputs, designated schematically in the FIGS. as EB1 and EB2, for connection to contacts or switches such as pressure switch 36. The logical states of the inputs EB1 and EB2 are utilized to selectively override the system setpoint signal 32 to effect transmission of a predetermined control signal 38 from the position controller 12' to the relay 14. In the example shown, these two inputs EB1 and EB2 enable four discrete states to be implemented, as set forth in the following truth table (Table 1).

TABLE 1

| (EB1) | (EB2) | Function |
|---|---|---|
| Closed | Closed | 1. The positioner is running normally according to input signal 32 |
| Opened | Closed | 2. The positioner generates an output signal 38 to move actuator to fully opened position |
| Closed | Opened | 3. The output positioner generates a signal 38 to move actuator to fully closed position |
| Opened | Opened | 4. The positioner generates an output signal 38 to hold actuator at its last value and does not follow the input signal |

Although this exemplary embodiment utilizes two discrete inputs to implement four discrete functions, one skilled in the art will recognize that any number N of binary inputs may be provided to enable implementation of $2^N$ discrete functions. The logic associated with the state of the inputs may be provided in any manner familiar to those skilled in the art. For example, the logic may be implemented in hardware utilizing conventional combinational logic, or in software utilizing conventional algorithms, lookup tables, or the like. Moreover, although the logic associated with input block 30 may be implemented within a gate array or microprocessor embedded within block 30, the logic may be implemented within the position controller 12'.

Referring to Table 1, in the embodiment shown, Function (1) is implemented when both inputs are disposed in their closed or "on" states. This configuration may be utilized to enable normal operation of the positioner 10 as directed by system setpoint signals 32 transmitted by system 34, (for example, conventional 4–20 mA input signals). Function (2) is implemented when input EB1 is toggled to it's open ("off") state, with EB2 remaining in it's closed state. This Function 2 instructs the controller 12' to maintain the actuator 18 in its fully opened position i.e., to fully open valve 22 in the embodiment shown. Function (3) is called when input EB1 is disposed in its closed or "on" state and EB2 is in its opened or "off" state. This function instructs controller 12' to maintain the actuator 18 in its fully closed position i.e., to terminate flow through valve 22 in the embodiment shown. Function (4) is called when both inputs are disposed in their open or "off" states. In this example, Function 4 instructs controller 12' to maintain actuator 18 at the last value indicated by system setpoint signal 32 and thus ignore any subsequent setpoint signals 32 transmitted by system 34. This Function 4 is implemented by effectively disconnecting or shunting setpoint signal 32 from the input block 30, and replacing it with an internal setpoint nominally equal to the feedback position signal 24 at the moment inputs EB1 and EB2 are both opened. In this manner, the position controller 12', which operates by minimizing any difference between a setpoint signal and feedback signal 24, will detect nominally no difference therebetween and thus maintain the actuator 18 at the position it was at nominally the moment both inputs were opened.

Although binary inputs EB1 and EB2 are preferably normally closed (N.C.), to effect normal operation when both are disposed in their closed states (i.e., to implement Function 1 as shown in Table 1), it should be recognized by those skilled in the art that the inputs may be normally open (N.O.) without departing from the spirit and scope of the present invention.

In the particular embodiment shown, a drop in pressure of supply 40 below a predetermined level opens the normally-open (N.O.) contacts of pressure switch 36 to call one of the four functions (i.e., Function 3) described hereinabove. In this manner, functionality formerly provided by the solenoid valve 16 (FIG. 1) of the prior art may be performed by the binary input block 30 coupled directly to the position controller 12' as shown. Moreover, additional functionality may be provided by a multi-level switch having two or more sets of contacts which open at various pressure levels, or by use of a second switch, as will be discussed in greater detail hereinbelow.

Referring now to FIGS. 3–7, the positioner 10' is shown in various alternative exemplary applications. It is to be understood that these examples should not be construed as limiting.

Figure 3:
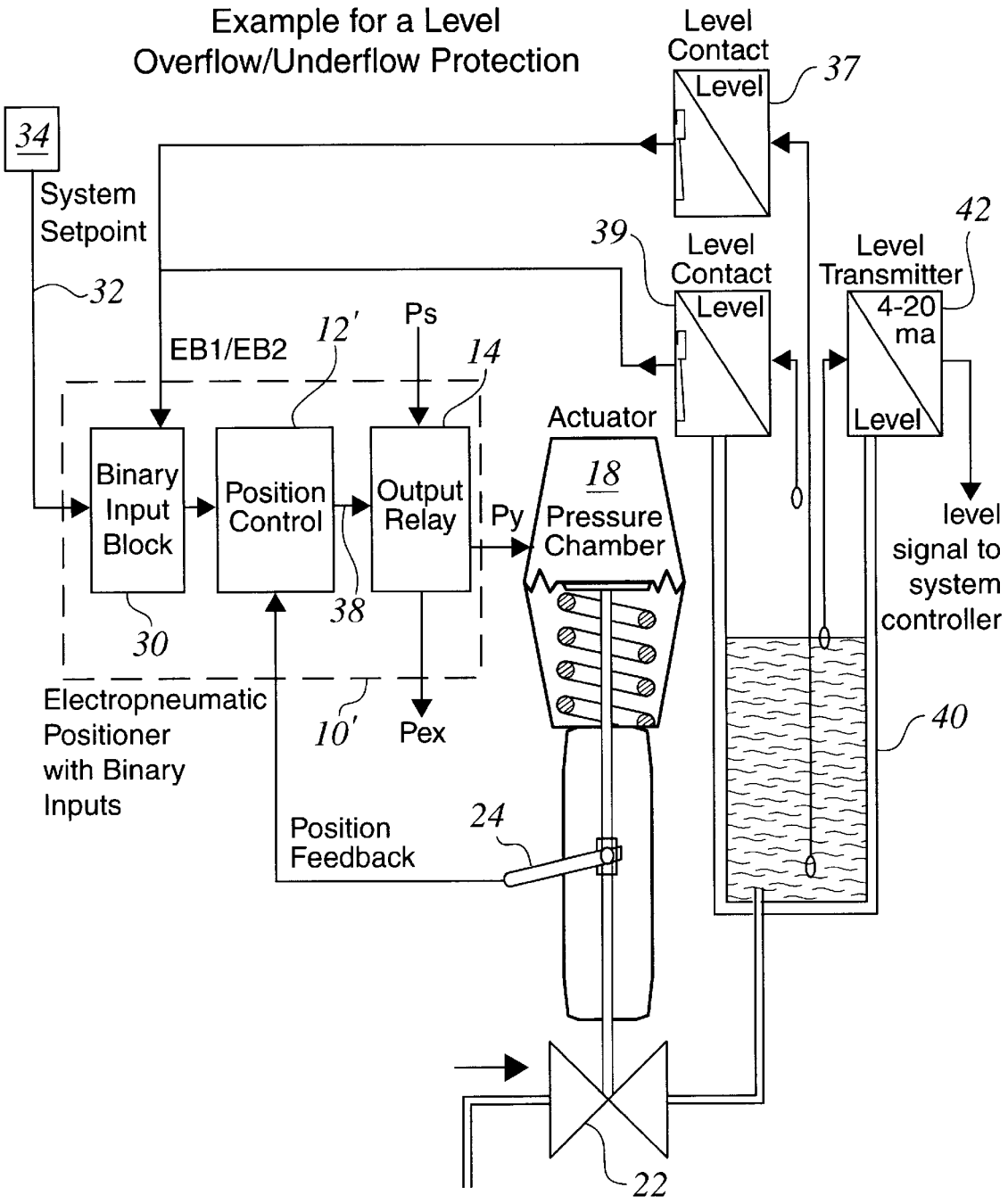
FIG. 3 is a schematic block diagram of the electropneumatic positioner with binary inputs of FIG. 2, in another representative application.

Turning to FIG. 3, electropneumatic positioner 10' of the present invention may be utilized in combination with a pair of level sensors 37 and 39 to protect a tank 40 from overflow or underflow in the event a level transmitter 42 coupled to system 34 malfunctions. In this regard, actuation of lower level sensor 37 may call Function 2, to refill the tank 40, while actuation of level contact 39 may be utilized to call Function 3 to discontinue flow through valve 22 and thus prevent overflow of the tank 40.

Figure 4:
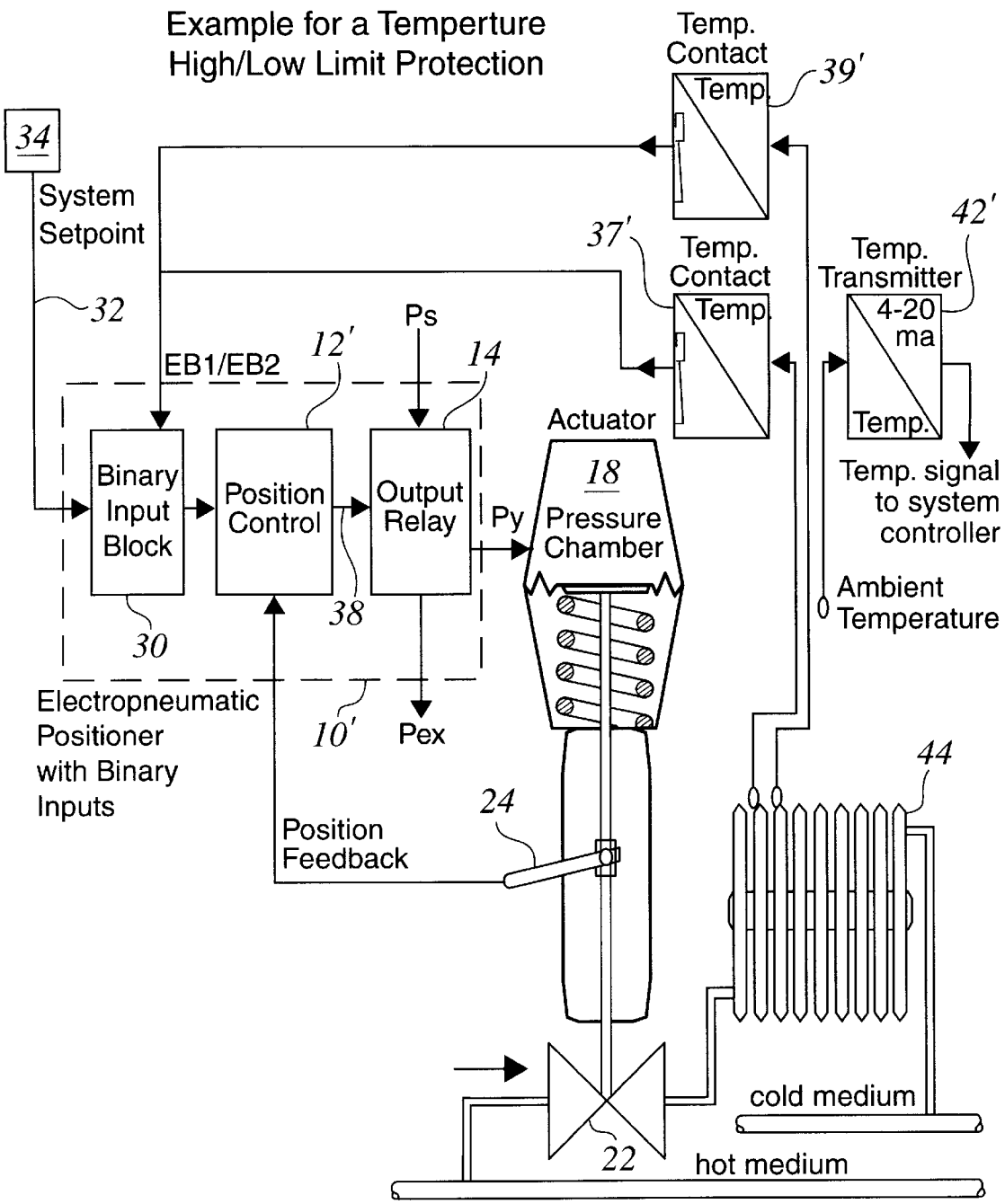
FIGS. 4–7 are schematic block diagrams of the electropneumatic positioner with binary inputs of the present invention, in additional representative applications.
Figure 5:
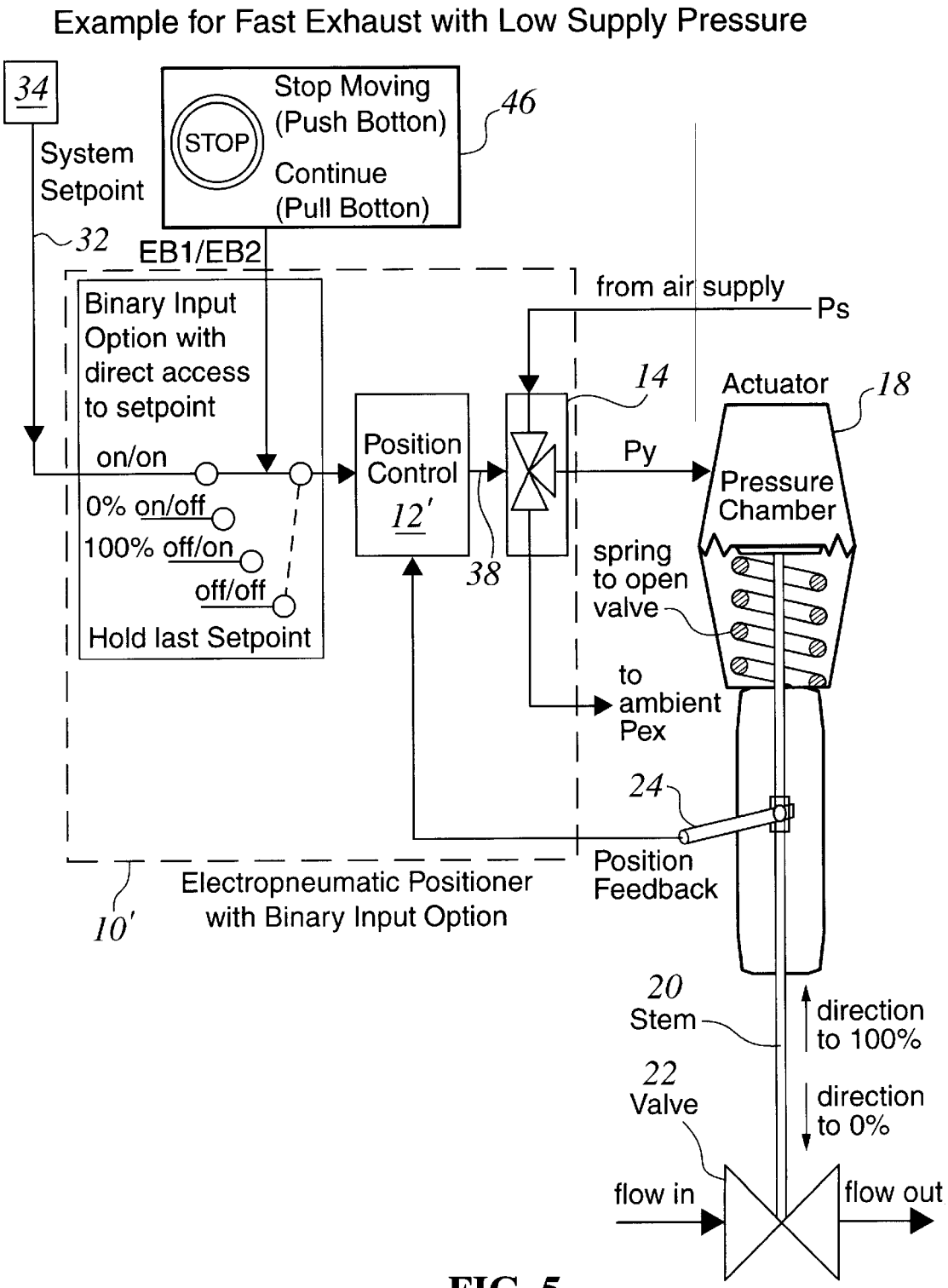
Figure 6:
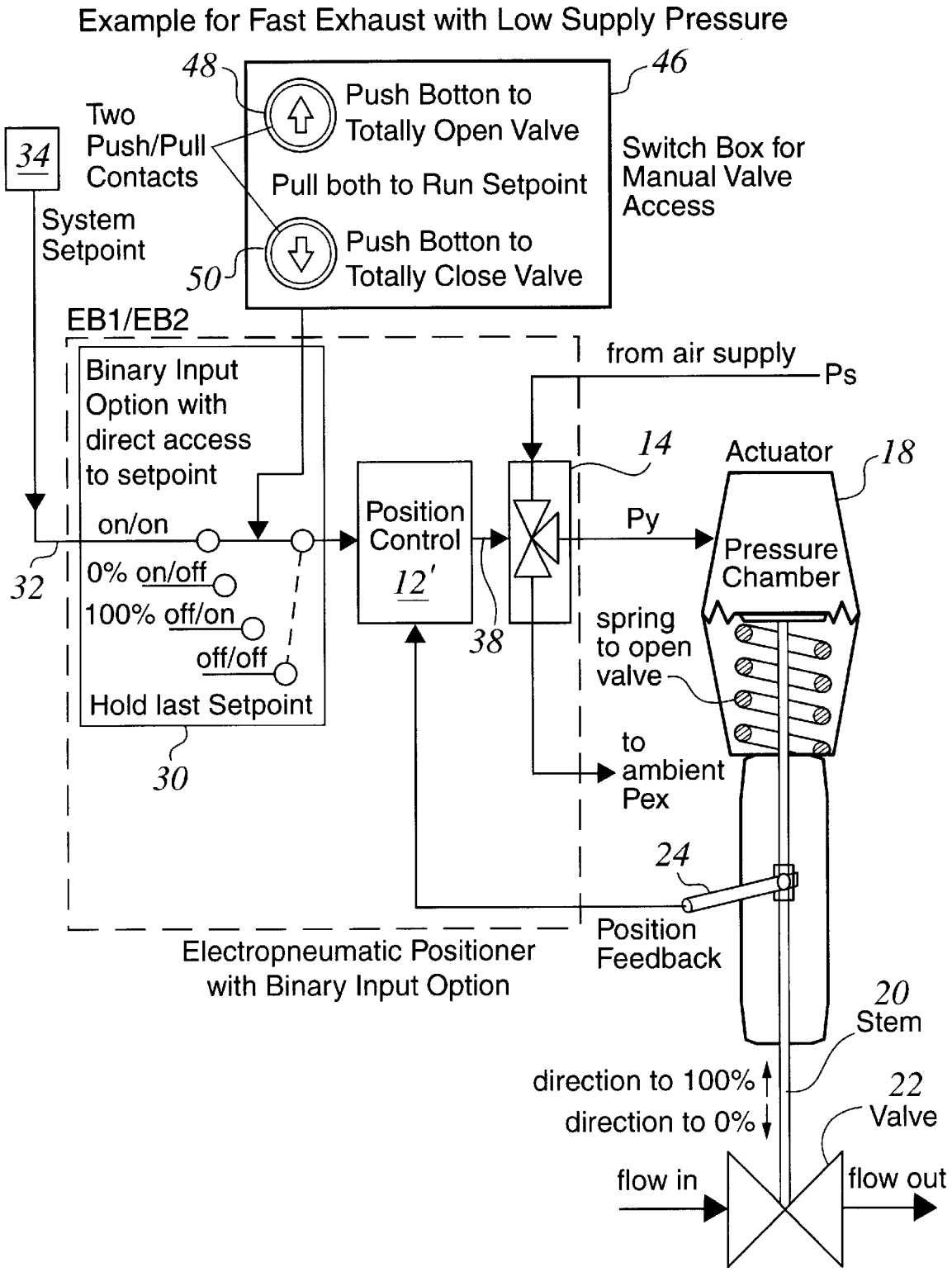

In FIG. 4, positioner 10' is utilized in an application similar to that of FIG. 3, which includes a pair of sensors 37' and 39' to protect a heater 44 from exceeding its predetermined operational temperature range. FIG. 5 discloses use of positioner 10' in combination with a user actuatable switch 46 to enable an operator to manually control actuator 18, such as may be desired to prevent bodily injury, etc., in particular plant environments. FIG. 6 is a variation of FIG. 5, in which a user operatable switch 46' is provided to enable a user to utilize four discrete functions such as described with respect to TABLE 1. For example, as shown, switch 46' includes two push/pull contacts 48 and 50, respectively coupled to inputs EB1 and EB2, to enable a user to manually control actuator 18 as described hereinabove.

Figure 7:
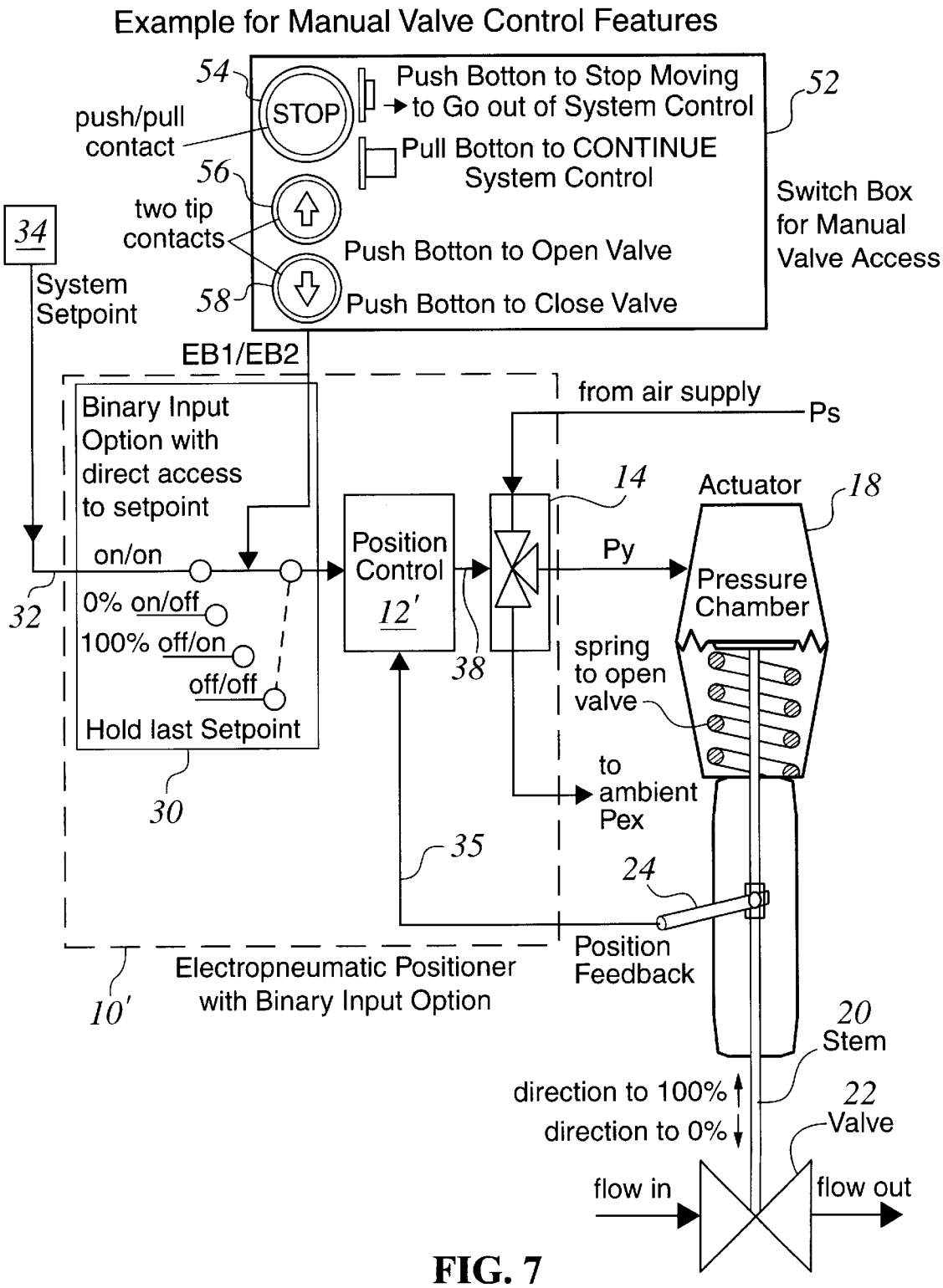
Figure 7A:
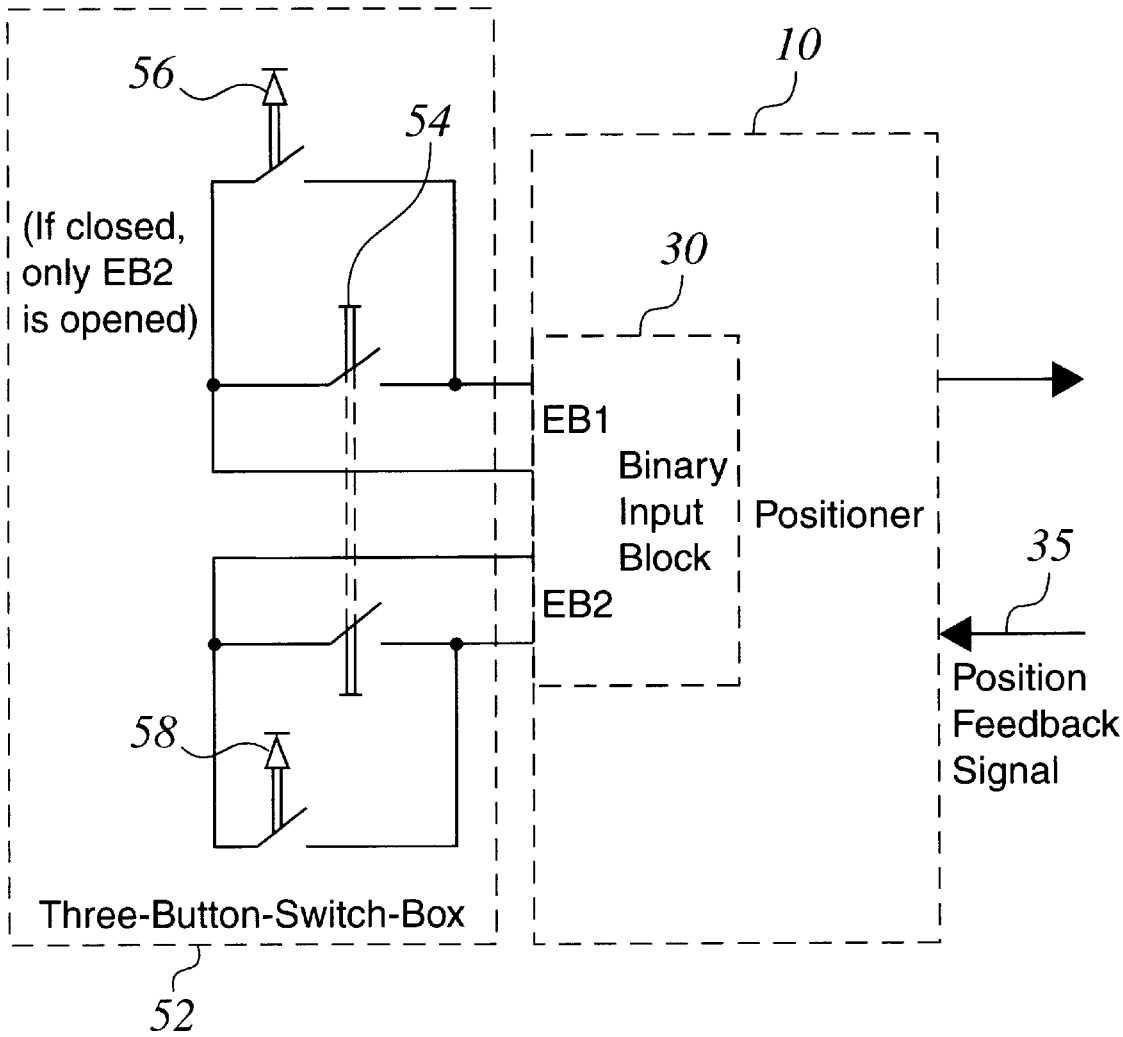
FIG. 7*a* is a schematic block diagram of a three-button switch utilized in combination with the electropneumatic position with binary inputs of the present invention.

Turning now to FIGS. 7 and 7*a*, positioner 10' is utilized in an application which is a combination of those shown in FIGS. 5 and 6. This configuration utilizes a three button switch 52 to enable adjustment of actuator 18 to substantially any position within its operational range of motion, i.e. from the 0 percent to 100 percent open position thereof. As shown in FIG. 7*a*, switch 52 may include a push/pull switch 54 having two sets of contacts which are actuated simultaneously to enable a user to open both inputs EB1 and EB2 to execute Function 4 (to hold the actuator at its last position). The user may then selectively operate button 56 or 58 to close one of the binary inputs EB1 or EB2 to generate movement of the actuator 18. Since typical actuators 18 have travel times of 1 second up to several minutes, after an enable, such as to move to its fully opened or fully closed position (i.e., Functions 2 and 3), an operator may hold the button 56 or 58 closed until the actuator 18 moves to a desired position. Once the desired position has been reached, the button 56 or 58 may be opened (i.e., released in the event a normally open switch is utilized) to re-enable Function 4 to leave the actuator at that last position. Thereafter, push/pull contact 54 may be actuated to close both inputs EB1 and EB2 (to execute Function 1) to resume normal control by system 34.

In an alternate embodiment, 3 button switch 52 may be utilized to move actuator 18 to its fully opened position (Function 2), fully closed position (Function 3) and the last position as determined by the last system setpoint signal 32 received prior to simultaneous actuation of inputs EB1 and EB2 (i.e. by switch 54). In this embodiment, the last system setpoint signal 32 received prior to operation of switch 54 may be stored in a predetermined memory location. Thereafter, independent operation of switches 56 and 58 will implement Functions 2 and 3. Further independent, sequential actuation (i.e., substantially non-simultaneous) of the switches 56 and 58 to implement Function 4 will utilize the setpoint signal stored at the predetermined memory location as the substitute setpoint signal. Thus, actuator 18 is moved to the last position prior to actuation of switch 54, rather than to the last position as determined by the feedback signal 24 as discussed hereinabove. In this manner, any sequential operation of switches 56 and 58 implements Functions 2, 3 and 4 to move actuator 18 to only three discrete positions, i.e., 0%, 100% and the last position prior to the substantially simultaneous opening of inputs EB1 and EB2 (i.e., by actuation of switch 54).

Figure 8:
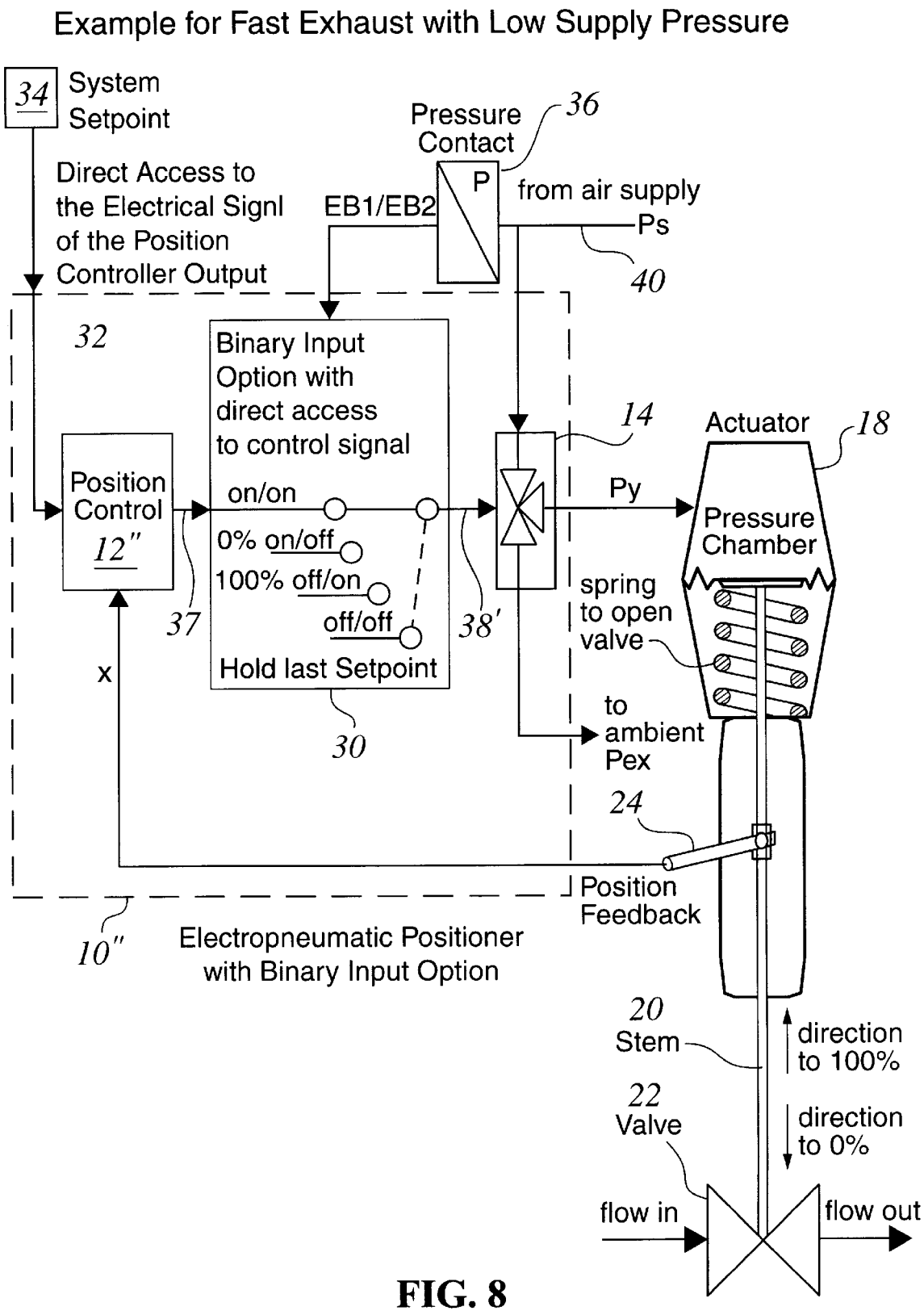
FIG. 8 is a view similar to that of FIG. 2, of an alternate embodiment of an electropneumatic positioner with binary inputs of the present invention in a representative application.

Turning now to FIG. 8, an alternate embodiment of the present invention is shown as positioner 10" which includes a position controller 12" in combination with a binary input block 30' and a valve relay 14. Positioner 10" is shown, for example, in an application substantially similar to that shown in FIG. 2. In this embodiment, rather than overriding the system setpoint 32 as discussed hereinabove with respect to the embodiment of FIGS. 2 to 7, positioner 10" utilizes binary input block 30' to effectively override the output signal 37 of the position controller 12". When the binary inputs EB1 and/or EB2 change state, the binary input block 30' effectively blocks or shunts signal 37 and generates an output signal 38' to the valve relay 14 which is predetermined to move the actuator 18 to a desired position, such as to its 0 percent, 100 percent or last position. In this instance, since the output 37' from the position controller 12' is shunted or otherwise disregarded, the position feedback signal 24 is not utilized during override of signal 37, so that Functions 2–4 are effected without the benefit of feedback. Accordingly, the 0 percent and 100 percent, etc. positions are determined simply by utilizing relay 14 to channel a predetermined proportion of the pneumatic pressure to the actuator 18. For example, the 0 percent and 100 percent positions are provided by actuating relay 14 to channel a minimum and maximum amount of pneumatic pressure to the actuator 18. The actuator would then be moved to the mechanical limits of the actuator 18 and/or valve 22. Intermediate positions, such as an approximately 50 percent position, may be accomplished by disposing relay 14 in an intermediate position to supply a predetermined intermediate pneumatic pressure to the actuator 18.

The functionality of binary input block 30' may be provided in any convenient manner, such as in hardware, software or a combination thereof as discussed hereinabove with respect to positioner 10'. Input block 30' may generate Function 4 (i.e., "hold last output value") by any convenient methodology. For example, the most recent output value generated by position controller 12" may be retrieved from a suitable register or memory address location disposed within a processor or memory device associated with the position controller 12" and/or binary input block 30'. Positioner 10" preferably provides its desired functionality by placing position controller 12" into a hold state upon any change of state of the binary input block 30' (i.e., to actuate Functions 2–4). Functions 2 and 3 may be thus provided by effectively shunting or otherwise disregarding output signal 37, while Function 4 is preferably implemented by simply passing the held signal 37 to valve relay 14 as signal 38'.

The positioner 10' as shown and discussed with respect to FIGS. 2 to 7 hereinabove preferably utilizes position feedback signal 24 to maintain actuator 18 and valve 22 in desired override positions as indicated by binary input block 30. Those skilled in the art should recognize that positioner 10' may be operated without any feedback to dispose actuator 18 and/or valve 22 at the 0 percent or 100 percent position, such as defined by mechanical limits of movement, or an intermediate position, by instructing the position controller 12' to generate a minimum, maximum, or predetermined intermediate output signal 38 to thus operate in a manner similar to that discussed with respect to positioner 10". The predetermined intermediate output signal may include the last output signal prior to simultaneous opening of both inputs EB1 and EB2, as discussed hereinabove with respect to FIGS. 7 and 7*a*.

In one embodiment of such a non-feedback controlled arrangement, actuator 18 and/or valve 22 may be moved to their outer mechanical limits by providing a substitute feedback signal of less than −1% or greater than +101%. Position controller 12' will then move actuator 18 to reduce the difference between the setpoint signal and the feedback signal, until the actuator and/or valve reaches its limits.

The binary input block 30 and 30' of the present invention thus effectively enables an automatic or user actuated switch to override a position setpoint signal 32 being provided by a factory automation or similar system 34. This direct access to the position controller 12' and 12" advantageously eliminates the need for an override solenoid valve 16 disposed downstream of the valve 14 (and pneumatic conduit associated therewith) for improved capital, installation and maintenance costs relative to the prior art. Moreover, operation of the input blocks 30 and 30' may be conveniently tested by modifying flow through valve 22, i.e., by testing Functions 1, 2 and 4, above, without completely discontinuing flow therethrough, for reduced disruption of normal plant operation.

Although the present invention has been described herein as utilized in pneumatic systems, one skilled in the art should recognize that substantially any fluid whether gaseous or liquid, including hydraulic fluid, may be utilized without departing from the spirit and scope of the present invention.

The foregoing description is intended primarily for purposes of illustration. Although the invention has been shown and described with respect to an exemplary embodiment thereof, it should be understood by those skilled in the art that the foregoing and various other changes, omissions, and additions in the form and detail thereof may be made therein without departing from the spirit and scope of the invention.

Having thus described the invention, what is claimed is:

1. An electropneumatic positioner for controlling operation of a pneumatic valve actuator, the electropneumatic positioner comprising:

a position controller electrically coupled to a pneumatic relay;

said pneumatic relay adapted for selective coupling, decoupling and modulation of pneumatic fluid flow to the pneumatic valve actuator in response to signals transmitted by said position controller;

at least one binary input integrally coupled to said position controller, wherein a change of state of said at least one binary input is adapted to selectively effect one of a plurality of functions.

2. The electropneumatic positioner of claim 1, wherein said plurality of functions comprise disposing said pneumatic relay at one of a plurality of positions.

3. The electropneumatic positioner of claim 2, further comprising a plurality of binary inputs.

4. The electropneumatic positioner of claim 3, further comprising N binary inputs to selectively effect one of $2^N$ functions.

5. The electropneumatic positioner of claim 3, wherein said plurality of positions comprise a fully opened position, a fully closed position and a last position.

6. The electropneumatic positioner of claim 5, further comprising a position feedback signal coupled to said position controller to indicate actual position of the pneumatic valve actuator.

7. The electropneumatic positioner of claim 6, wherein said last position function is provided by utilizing said position feedback signal as a setpoint signal.

8. The electropneumatic positioner of claim 6, wherein said fully opened position and said fully closed position is provided by substituting said position feedback signal with a signal indicating that the actual position of the pneumatic valve actuator is less than fully closed and greater than fully opened, respectively.

9. The electropneumatic positioner of claim 3, wherein said plurality of binary inputs are disposed integrally with said position controller.

10. The electropneumatic positioner of claim 1, wherein said position controller further comprises a port adapted to receive a setpoint signal from a remote processor.

11. The electropneumatic positioner of claim 1, wherein said at least one binary input is adapted for being coupled to a switch.

12. The electropneumatic positioner of claim 11, further comprising a plurality of binary inputs each being coupled to a switch.

13. The electropneumatic positioner of claim 12, wherein said switch is user actuatable.

14. The electropneumatic positioner of claim 12, wherein said switch is automatically actuatable.

15. The electropneumatic positioner of claim 12, further comprising a plurality of discrete switches coupled to respective ones of said plurality of binary inputs.

16. The electropneumatic positioner of claim 1, wherein said position controller comprises a microprocessor.

17. The electropneumatic positioner of claim 16, wherein said microprocessor further comprises combinational logic adapted to implement said plurality of functions according to the states of said at least one binary input.

18. The electropneumatic positioner of claim 17, wherein said combinational logic is disposed integrally with said at least one binary input.

19. The electropneumatic positioner of claim 16, wherein said position controller further comprises a microprocessor usable medium having microprocessor readable program code disposed thereon for implementing said plurality of functions according to the states of said at least one binary input.

20. The electropneumatic positioner of claim 19, wherein said microprocessor usable medium is disposed integrally with said at least one binary input.

21. The electropneumatic positioner of claim 1, wherein a change of state of said at least one binary input selectively overrides setpoint signals inputted to said position controller.

22. The electropneumatic positioner of claim 21, wherein a change of state of said at least one binary input selectively overrides said signals transmitted by said position controller to transmit override signals to said pneumatic relay.

23. The electropneumatic positioner of claim 21, wherein a change of state of said at least one binary input disposes said position controller into a hold mode to generate a constant output signal, and said output signal is selectively overridden or transmitted to said pneumatic relay.

24. An electropneumatic positioner for controlling operation of a pneumatic valve actuator, the electropneumatic positioner comprising:

an electronic position controller;

a pneumatic relay electrically coupled to said position controller and pneumatically coupled to the pneumatic valve actuator;

a setpoint signal input port integrally coupled to said position controller; and at least one binary input integrally coupled to said position controller, wherein a change of state of said at least one binary input selectively overrides setpoint signals inputted to said setpoint signal input port.

25. The electropneumatic positioner of claim 24, wherein a change of state of said at least one binary input selectively overrides signals transmitted by said position controller to transmit override signals to said pneumatic relay.

26. The electropneumatic positioner of claim 25, wherein a change of state of said at least one binary input disposes said position controller into a hold mode wherein the output signal generated thereby is held constant, and said output signal is selectively overridden or transmitted to said pneumatic relay.

27. A method for controlling operation of a pneumatic valve actuator, the method comprising the steps of:

(a) providing a position controller;

(b) providing a pneumatic relay;

(c) electrically coupling the position controller to the pneumatic relay;

(d) pneumatically coupling the pneumatic relay to the pneumatic valve actuator;

(e) integrally coupling at least one binary input to the position controller;

(f) utilizing the position controller to transmit control signals to the pneumatic relay to selectively couple, decouple and modulate pneumatic fluid flow to the pneumatic valve actuator; and (g) selectively changing the state of the at least one binary input to selectively determine which one of a plurality of control signals is transmitted to the pneumatic relay.

28. The method of claim 27, further comprising the steps of (h) integrally coupling a setpoint signal input port to the position controller; and (i) inputting a setpoint signal to the setpoint signal input port to control operation of the position controller, wherein a change of state of the at least one binary input selectively overrides the setpoint signal to transmit one of a plurality of control signals to the pneumatic relay.

29. An electropneumatic positioner for controlling operation of a pneumatic valve actuator, the electropneumatic positioner comprising:

a positioner controller;

a pneumatic relay;

said pneumatic relay being electrically coupled to said position controller and pneumatically coupled to the pneumatic valve actuator;

said position controller adapted to transmit control signals to said pneumatic relay to effect selective coupling, decoupling and modulation of pneumatic fluid flow between said pneumatic relay and the pneumatic valve actuator;

a port electrically coupled to said position controller, said port being adapted to receive a setpoint signal from a remote processor; and a plurality of binary inputs integrally coupled to said position controller, wherein a change of state of at least one of said plurality of binary inputs is adapted to selectively override the setpoint signal inputted at said port to transmit one of a plurality of control signals from said position controller to said pneumatic relay.

* * * * *